US007048895B2

(12) United States Patent
Shirahata et al.

(10) Patent No.: US 7,048,895 B2
(45) Date of Patent: May 23, 2006

(54) EXHAUST GAS PURIFYING APPARATUS

(75) Inventors: Junya Shirahata, Ogasa-gun (JP); Masayasu Sato, Ogasa-gun (JP); Teruhiko Ozawa, Ogasa-gun (JP)

(73) Assignee: Cataler Corporation, Shizuoka (JP)

( * ) Notice: Subject to any disclaimer, the term of this patent is extended or adjusted under 35 U.S.C. 154(b) by 745 days.

(21) Appl. No.: 10/058,753

(22) Filed: Jan. 30, 2002

(65) Prior Publication Data

US 2003/0095896 A1 May 22, 2003

(30) Foreign Application Priority Data

Nov. 21, 2001 (JP) ..... 2001-356067

(51) Int. Cl.
*F01N 3/28* (2006.01)

(52) U.S. Cl. ..... 422/180; 422/177

(58) Field of Classification Search ..... 422/171, 422/177, 180

See application file for complete search history.

(56) References Cited

U.S. PATENT DOCUMENTS

| | | | | |
|---|---|---|---|---|
| 4,175,107 A | | 11/1979 | Iwaoka et al. | 422/180 |
| 5,272,875 A | * | 12/1993 | Kaji | 422/180 |
| 5,332,554 A | * | 7/1994 | Yasaki et al. | 422/180 |
| 6,689,327 B1 | * | 2/2004 | Reck et al. | 422/180 |

FOREIGN PATENT DOCUMENTS

| | | | |
|---|---|---|---|
| DE | 195 30 142 | * | 2/1997 |
| EP | 0 318 462 A2 | | 5/1989 |
| EP | 0 939 207 A1 | | 9/1999 |
| FR | 2 775 498 | | 9/1999 |
| JP | 04140413 | | 5/1992 |
| JP | A 5-86843 | | 4/1993 |
| JP | 05231140 | | 9/1993 |
| JP | A 5-312030 | | 11/1993 |
| JP | A 7-54642 | | 2/1995 |
| JP | A 7-269331 | | 10/1995 |
| JP | 08093459 | | 4/1996 |
| JP | A 10-299469 | | 11/1998 |

* cited by examiner

*Primary Examiner*—Hien Tran
(74) *Attorney, Agent, or Firm*—Oliff & Berridge, PLC

(57) ABSTRACT

An exhaust gas purifying apparatus includes an exhaust pipe 2*a* for forming an exhaust way 2, and a catalyst disposed in the exhaust way 2 for purifying an exhaust gas. The catalyst includes the first honeycomb catalyst portion 3*a* and the second honeycomb catalyst portion 4*a*. The first honeycomb catalyst portion 3*a* has an outer circumferrencial surface for forming a blowing passage 200 with an inner circumferrencial surface of the exhaust pipe 2*a*. The radial cross sectional area in the catalyst region of the first honeycomb catalyst portion 3*a* is set in the 1/5–2/3 range with respect to the radial cross sectional area of a flowing way defined by the inwall surface of the first mounting position 3*a* placed in the exhaust way 2, with the first honeycomb catalyst portion 3*a* being removed.

14 Claims, 8 Drawing Sheets

EXHAUST GAS PURIFYING APPARATUS

BACKGROUND OF THE INVENTION

1. Field of the Invention

The present invention relates to an exhaust gas purifying apparatus containing an exhaust pipe for forming an exhaust way communicated with an exhaust port of an engine, and a catalyst disposed in the exhaust way for purifying exhaust gas.

2. Description of the Related Art

Conventionally, in a small size engine such as a motorcycle engine, a cylindrical catalyst is used for purifying exhaust gas discharged from an exhaust port of a motorcycle engine to an exhaust way of an exhaust pipe. This cylindrical catalyst contains a punching tube with a center hole and a catalyst component retained on the punching tube. This cylindrical catalyst is disposed to cover an inwall surface of the exhaust way for gaining an engine output sufficiently. This cylindrical catalyst is high in a blowing rate so as to suppress a pressure loss for ensuring the engine output. This cylindrical catalyst, however, is a small area to react with the exhaust gas, exhibiting a low purification-rate. So, this cylindrical catalyst sometimes requires the honeycomb catalyst at the downstream of the cylindrical catalyst in the exhaust way for improving the purifying ability.

Further, Patent Publications disclose some exhaust gas purifying apparatus with the cylindrical catalyst which retains a catalyst component on a punching tube in following (1)–(5).

(1) Japanese Unexamined Patent Publication (KOKAI) No.10-299,469 (1998) discloses an exhaust gas purifying apparatus with a catalyst pipe in which a catalyst component is retained on an inner circumferential surface and on an outer circumferential surface of a punching pipe capable of swinging in the central region located in a radial direction of the exhaust way of the muffler of the 2-stroke cycle engine. For activating the catalyst component, it is desirable that the catalyst pipe is heated over the predetermined temperature. Accordingly, the catalyst pipe is moved to an upstream side in the muffler for activating the catalytic reaction, when temperature in the muffler is low like an engine-idling period. The catalyst pipe is moved to the downstream side in the muffler to suppress overheat of the catalyst, when the temperature in the muffler is high. In this apparatus, the number of catalyst pipe is only one.

(2) Japanese Unexamined Patent Publication (KOKAI) No. 5-312,030 (1993) discloses an exhaust gas purifying apparatus in which a cylindrical catalyst retaining a catalyst component is installed at a central portion of an exhaust way of the muffler by a holding plate having a disk-shape. This apparatus has a blowing hole in the holding plate to discharge exhaust gas. So, the exhaust gas runs into a cylindrical catalyst. The remainder of the exhaust gas runs not through the cylindrical catalyst but through the blowing hole of the holding plate. In this apparatus, the number of catalyst pipe is only one.

(3) Japanese Unexamined Patent Publication (KOKAI) No. 7-54,642 (1995) discloses an exhaust gas purifying apparatus which contains: an exhaust pipe connected with the exhaust port of the engine, and an exhaust muffler connected with the downstream side of the exhaust pipe. This apparatus has the cylindrical main catalyst member disposed coaxially to cover the inwall surface of the exhaust pipe. The exhaust gas is purified by the main catalyst member when the engine is driven. However, when the main catalyst member is not sufficiently heated in an engine starting period, the activation of the main catalyst member is insufficient. Then, this apparatus is provided with a sub catalyst member, namely, a cylindrical portion retaining the catalyst component, at the portion connected with the exhaust port of the engine in the exhaust pipe. The sub catalyst member is early heated to be activated in the engine starting period, since it is near to the exhaust port of the engine. Accordingly, the purification rate is improved in the engine starting period.

(4) Japanese Unexamined Patent Publication (KOKAI) No. 7-269,331 (1995) discloses an exhaust gas purifying apparatus including a punching pipe with a catalyst component and covering an inner surface of the exhaust pipe coaxially.

(5) Japanese Unexamined Patent Publication (KOKAI) No. 5-86,843 (1993) discloses an exhaust gas purifying apparatus in which the main catalyst 100 for purifying the exhaust gas is placed at a downstream side of an exhaust way 220 of a body 210 connected with the exhaust pipe 200. The apparatus shown in FIG. 10 has a pre-catalyst 300 placed in an upstream side of the main catalyst 100. A blowing passage 400 is formed between an outer circumferential surface of the pre-catalyst 300 and an inwall surface of the exhaust way 220. The pre-catalyst 300 is formed of a ceramic honeycomb carrier 301 retaining a catalyst component, and it is held in an external sleeve 302 by cushions 303 for preventing the damage of the ceramic honeycomb carrier 301 as shown in FIG. 11. The pre-catalyst 300 is placed by a supporting member 330 (a width of "M", a thickness of "t") in the center region located in a radial direction of the exhaust way 220. The apparatus shown in FIG. 10 is provided with a closing plate 212 for reflecting the exhaust gas. The closing plate 212 is placed distance "LA" apart at the downstream side of the main catalyst 100 in the body 210 so as to face the flow of the exhaust gas.

SUMMARY OF THE INVENTION

The exhaust gas purifying apparatus of aforesaid publications has a complicated constitution; therefore, they requires an improvement for a simple constitution for raising a purification rate of the exhaust gas without decreasing the engine output. In addition, according to the cylindrical catalyst used in the conventional technique, since it is formed of the punching tube retaining the catalyst component, the contact area with exhaust gas is small, and the purification rate is not sufficient.

Further, according to the apparatus (shown in FIGS. 10 and 11) disclosed in Japanese Unexamined Patent Publication (KOKAI) No. 5-86,843, the honeycomb catalyst, exhibiting a high rate in purifying the exhaust gas, is used as the pre-catalyst 300 instead of the punching tube exhibiting a low rate in purifying the exhaust gas. However, according to the pre-catalyst 300 formed of the ceramic honeycomb carrier 301 retaining the catalyst component, a reaction area with the exhaust gas is larger than that of the punching tube; so, purification rate is higher than that of the punching tube. The ceramic honeycomb carrier 301, however, is high in resistance and pressure loss of the exhaust gas.

Accordingly, the apparatus shown in FIGS. 10 and 11 increases the resistance and the pressure loss in discharging the exhaust gas into the exhaust way 220. As a result, the apparatus shown in FIGS. 10 and 11 decreases the output of the engine considerably while ensuring the purification rate of exhaust gas. So, it is necessary to largely increase an area of the blowing passage 400. When the area of the blowing passage 400 placed at the outer circumferrencial side of pre-catalyst 300 is large, the exhaust gas superfluously runs through the blowing passage 400, thereby reducing a purification ability of the exhaust gas. Reversely, when the area of the blowing passage 400 is superfluously decreased to reduce the quantity of exhaust gas which runs through the blowing passage 400, the engine output is considerably reduced.

In addition, the pre-catalyst 300 formed of the honeycomb catalyst is near to the exhaust port of the engine to generate thermal problems of the pre-catalyst 300, being in high temperatures.

The present invention has been accomplished in view of the aforesaid circumstances. It is therefore an object of the present invention to provide an exhaust gas purifying apparatus which raises a purification ability of an exhaust gas by a simple construction while suppressing the decrease of the engine output.

According to a first aspect of the present invention, an exhaust gas purifying apparatus comprising an exhaust pipe for forming an exhaust way communicated with an exhaust port of an engine, and a catalyst disposed in the exhaust way for purifying an exhaust gas;

the improvement comprising:

the exhaust way of the exhaust pipe having a first mounting position and a second mounting position disposed at the downstream side with respect to the first mounting position;

the catalyst having a first honeycomb catalyst portion placed at the first mounting position of the exhaust way and a second honeycomb catalyst portion placed at the second mounting position of the exhaust way, the first honeycomb catalyst portion having an outer circumferential surface for forming a blowing passage with an inwall surface of the exhaust pipe and including a metallic first carrier with a plurality of holes being along a length direction of the exhaust way of the exhaust pipe, the second honeycomb catalyst portion including a metallic second carrier with a plurality of holes being along a length direction of the exhaust way of the exhaust pipe; and wherein the radial cross sectional area in a catalyst region of the first honeycomb catalyst portion is set in the 1/5–2/3 range with respect to the radial cross sectional area of a flowing way defined by the inwall surface of the first mounting position of the exhaust way with the first honeycomb catalyst portion being removed.

Effect of the Invention

According to the first aspect of the present invention, the radial cross sectional area in the catalyst region of the first honeycomb catalyst portion is set in the 1/5–2/3 range with respect to the radial cross sectional area of the flowing way formed by the inwall surface of the first mounting position of the exhaust way, with the first honeycomb catalyst portion being removed. Therefore, it is possible to raise a purification ability of the exhaust gas while suppressing the decrease of the engine output.

According to the exhaust gas purifying apparatus of the present invention, the catalyst has: (1) the first honeycomb catalyst portion placed at the first mounting position of the exhaust way; and (2) the second honeycomb catalyst portion placed at the second mounting position of the exhaust way. The first honeycomb catalyst has the outer circumferential surface for forming the blowing passage with the inwall surface of the exhaust pipe, including the metallic first carrier with a plurality of holes being along a length direction of the exhaust way of the exhaust pipe. The second honeycomb catalyst portion includes the metallic second carrier with a plurality of holes being along a length direction of the exhaust way of the exhaust pipe. The radial cross sectional area in the catalyst region of the first honeycomb catalyst portion is set in the 1/5–2/3 range with respect to the radial cross sectional area of the flowing way defined by the inwall surface of the first mounting position of the exhaust way with the first honeycomb catalyst portion being removed.

Accordingly, the exhaust gas discharged from the exhaust port of the engine can be purified in both of the first honeycomb catalyst portion and the second honeycomb catalyst portion; so, the purification rate is higher. The exhaust gas discharged from the exhaust port of the engine is divided into: (1) one flow which runs through the blowing passage to the second honeycomb catalyst portion without running through the holes of the first honeycomb catalyst portion; and (2) the other flow which runs through the holes of the first honeycomb catalyst portion into the second honeycomb catalyst portion. This can ensure a flow quantity of the exhaust gas by the blowing passage to suppress the decrease of the engine output. This can ensure a purification ability, since the exhaust gas runs through the blowing passage formed at the outer circumferential surface of the first honeycomb catalyst portion into the second honeycomb catalyst portion placed at the downstream side.

The carrier of the first honeycomb catalyst portions being formed of metal, can increase an area for reacting with the exhaust gas to ensure a flow area of holes in comparison with a ceramic carrier. This can decrease a passage resistance of the exhaust gas. Also, this can advantageously prevent a pressure loss so as to improve the engine output even in the case where the first honeycomb catalyst portion is near to the exhaust port of the engine.

The exhaust gas, having high-temperature, runs through the first honeycomb catalyst portion being near to the exhaust port of the engine. Accordingly, although the first honeycomb catalyst portion has a small reaction-area owing to the blowing passage, it can ensure the purification rate. Further, the carrier of the first honeycomb catalyst portion, being near to the exhaust port of the engine, is to be in high-temperature: the carrier of the first honeycomb catalyst portion is formed of metal to improve a heat conduction quantity. So, the carrier of the first honeycomb catalyst portion can advantageously increase a thermal conduction quantity to the exhaust pipe so as to suppress a thermal damage of the first honeycomb catalyst portion.

The second honeycomb catalyst portion, is far from the exhaust port of the engine in comparison to the first honeycomb catalyst portion. So, the temperature of the exhaust gas is to be decreased in the second honeycomb catalyst portion. However, the exhaust gas is heated in temperature by catalytic reaction in the first honeycomb catalyst portion, and the heated exhaust gas runs into the inlet of the holes of the second honeycomb catalyst portion. So, the exhaust gas flowing into the inlet of the second honeycomb catalyst portion is advantageously high in temperature, thereby raising a purification rate of the exhaust gas in the second honeycomb catalyst portion.

Accordingly, the exhaust gas purifying apparatus according to the present invention raises a purification ability of the exhaust gas by a simple construction while suppressing the decrease of the engine output.

Suitable Mode of the Invention

According to the present invention, the radial cross sectional area of the catalyst region of the first honeycomb catalyst portion means the radial cross sectional area of the catalyst region along a radial direction of the first honeycomb catalyst portion, exhibiting an inlet of the first honeycomb catalyst portion.

In other words, "St" (suffix t: Total) exhibits the radial cross sectional area of the flowing way defined by the inwall surface of the first mounting position of the exhaust way, with the first honeycomb catalyst portion being removed. "Sc" (suffix c: Catalyst) exhibits the radial cross sectional area in the catalyst region of the first honeycomb catalyst portion. The ratio of Sc/St is set in the 1/5–2/3 range, namely, in the 0.2–0.67 range, in the 20%–67% range.

The reason why the ratio of Sc/St is set in the 1/5–2/3 range is as follows: As shown in FIG. 8, when the ratio of Sc/St is less than 1/5, a purification rate of the exhaust gas is remarkably decreased. As shown in FIG. 7, when the ratio of Sc/St exceeds 2/3, the engine output remarkably decreases.

The exhaust gas purifying apparatus according to the present invention is used in the exhaust system for discharging the exhaust gas of the engine. The engine, for example, the 2-stroke cycle engine or the 4-stroke cycle engine, etc. Further, the engine of the motorcycle or an engine of the four-wheeled vehicle is available.

According to the suitable mode of the present invention, the exhaust way of the exhaust pipe can include a small diameter portion with the first mounting position disposed at the upstream side of the exhaust way, and a large diameter portion with the second mounting position disposed at the downstream side in the exhaust way with respect to the small diameter portion. The area of the flowing way of the small diameter portion is smaller than that of the large diameter portion. The area of the flowing way of the large diameter portion can be 1.1–6 times, for instance 1.2–4 times as large as that of the small diameter portion. This is not limited to these magnifications. The first honeycomb catalyst portion is placed in the small diameter portion, and the second honeycomb catalyst portion is placed in the large diameter portion.

The density of the holes of the first honeycomb catalyst portion is preferably set in the range 40–200 cells per square inch. The reason is as follows: when the density of the holes of the first honeycomb catalyst portion is less than 40 cells per square inch, the catalytic reaction area of the first honeycomb catalyst portion is to be insufficient, and a catalyst ability and a structural strength of the catalyst are to be insufficient. When the density of the holes of the first honeycomb catalyst portion exceeds 200 cells per square inch, the pressure loss in the first honeycomb catalyst portion increases to reduce the engine output. When $\sigma 1$ (unit: cells per square inch) exhibits the density of holes of the first honeycomb catalyst portion, $\sigma 2$ (unit: cells per square inch) exhibits the density of holes of the second honeycomb catalyst portion, the present invention allows each of $\sigma 1 \approx \sigma 2$, $\sigma 1 < \sigma 2$, and $\sigma 1 > \sigma 2$.

The axial length of the first honeycomb catalyst portion is preferably 0.5–1 times as long as the diameter of the first honeycomb catalyst portion. When the axial length of the first honeycomb catalyst portion is less than 0.5 times, a catalytic reaction area in the first honeycomb catalyst portion is insufficient to reduce the purification ability owing to the blowing of the exhaust gas. When the axial length of the first honeycomb catalyst portion exceeds 1 times, the pressure loss in the first honeycomb catalyst portion increases to reduce the engine output. Still, the diameter of the first honeycomb catalyst portion contains an external sleeve, when it has the external sleeve.

According to the suitable mode of the exhaust gas purifying apparatus of the present invention, the first honeycomb catalyst portion can be installed at the first mounting position of the exhaust way by the first supporting member placed between the inwall surface of the exhaust way and the outer circumferential surface of the first honeycomb catalyst portion. The first supporting member may be a thin member (for example a stay) to decrease the passage resistance of the exhaust gas.

According to the suitable mode of the exhaust gas purifying apparatus of the present invention, the second honeycomb catalyst portion can be installed at the second mounting position of the exhaust way by the second supporting member placed between the inwall surface of the exhaust way and the outer circumferential surface of the second honeycomb catalyst portion. The second supporting member may substantially close the space between the inwall surface of the exhaust way and the outer circumferential surface of the second honeycomb catalyst portion. Therefore, it can effectively prevent that the exhaust gas is not purified by at least one of the first honeycomb catalyst portion and the second honeycomb catalyst portion; thereby ensuring the purification rate of the exhaust gas.

According to the suitable mode of the exhaust gas purifying apparatus of the present invention, the second honeycomb catalyst portion can be installed at the second mounting position of the exhaust way by the second supporting member placed between the inwall surface of the exhaust way and the outer circumferrencial surface of the second honeycomb catalyst portion. The second supporting member may substantially close the space between the inwall surface of the exhaust way and the outer circumferrencial surface of the second honeycomb catalyst portion. Therefore, it can effectively prevent that the exhaust gas is not purified by at least one of the first honeycomb catalyst portion and the second honeycomb catalyst portion; thereby ensuring the purification rate of the exhaust gas.

According to the suitable mode of the exhaust gas purifying apparatus, the second supporting member can form a second blowing passage of the exhaust gas between the inwall surface of the exhaust way of the exhaust pipe and the outer circumferential surface of the second honeycomb catalyst portion. In such case, the second blowing passage can discharge the exhaust gas so as to suppress the decreasing of the engine output advantageously.

According to the suitable mode of the exhaust gas purifying apparatus of the present invention, the first honeycomb catalyst portion can include a metallic first carrier retaining a catalyst component and a first external sleeve for holding the outer circumferential surface of the metallic first carrier. Also the second honeycomb catalyst portion can include a metallic second carrier retaining a catalyst component and a second external sleeve for holding the outer circumferential surface of the metallic second carrier. After a convolute body is formed by rolling a metallic wave plate and a metallic flat plate in a vortex shape, the metallic first carrier of the first honeycomb catalyst portion can be formed by bonding the convolute body with blazing material.

After another convolute body is formed by rolling another metallic wave plate and another metallic flat plate in a vortex shape, the metallic second carrier of the second honeycomb catalyst portion can be formed by bonding the convolute body with blazing material. The flat plate and the wave plate can be formed of heat resistant metal-heat resistant steel such as stainless steel. The following exemplifies the production technique of the first carrier of the first honeycomb catalyst portion and the second carrier of the second honeycomb catalyst portion. Firstly, the flat plate made of metallic foil and the wave plate made of metallic foil are rolled to be bonded with blazing material so as to form a sleeve having a large number of holes-honeycomb holes-opening in an axial direction. Nextly, a catalyst component layer is retained on the wall surface of the holes of the carrier for purifying the exhaust gas. The catalyst component can be made of at least one of platinum, palladium, rhodium, etc.

According to the suitable mode of exhaust gas purifying apparatus of the present invention, the second honeycomb catalyst portion can be larger than the first honeycomb catalyst portion in a purification ability per unit time. So, the second honeycomb catalyst portion may be a main catalyst and the first honeycomb catalyst portion may be a pre-catalyst.

When "Sc" (suffix c: Catalyst) exhibits the radial cross sectional area in the catalyst region of the first honeycomb catalyst portion, and when "Sb" (suffix b: Blow) exhibits the radial cross sectional area of the blowing passage, the ratio of Sc/Sb is set in the 0.25–2.06 range. The ratio of Sc/Sb is preferably set in the 0.25–2.06 range. Such case is advantageous in ensuring the purification ability of the exhaust gas while suppressing the decrease of the engine output. The ratio of Sc/Sb is not limited to the abovementioned range.

BRIEF DESCRIPTION OF THE DRAWING

A more complete appreciation of the present invention and many of its advantages will be readily obtained as the same becomes better understood by reference to the following detailed description when considered in connection with the accompanying drawing and detailed specification, all of which forms a part of the disclosure.

DETAILED DESCRIPTION OF THE PREFERRED EMBODIMENTS

Embodiments 1, 2, 3, 4, and 5 will hereinafter be described with reference.

Embodiment 1

Figure 1:
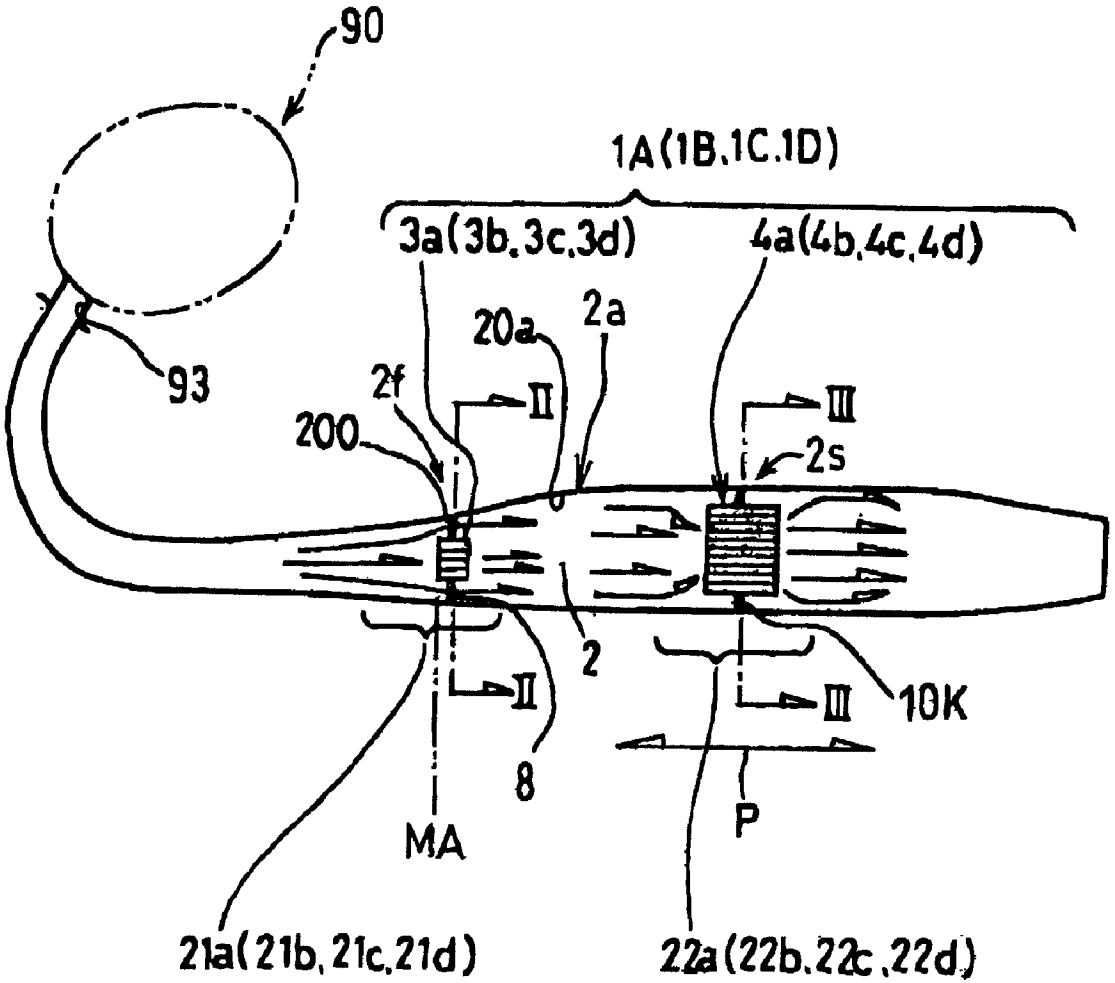
FIG. 1 schematically illustrates a sectional view showing a condition that an exhaust gas purifying apparatus concerning to Embodiments 1–4 along a flow direction of exhaust gas.

FIG. 1 illustrates an exhaust gas purifying apparatus 1A of Embodiment 1. The exhaust gas purifying apparatus 1A is applied to a 2-stroke cycle engine 90 of a motorcycle. This apparatus 1A has an exhaust pipe 2*a*, a first honeycomb catalyst portion 3*a*, and a second honeycomb catalyst portion 4*a*. The exhaust pipe 2*a* forms an exhaust way 2 communicated with the exhaust port 93 of the 2-stroke cycle engine 90. The fist honeycomb catalyst portion 3*a* is placed in a first mounting position 2*f* of a small diameter portion (the first catalyst region) 21*a* formed at an upstream side of the exhaust way 2. The second honeycomb catalyst portion 4*a* is placed in the second mounting position 2*s* of a large diameter portion 22*a* (the second catalyst region) formed at a downstream side separated at a predetermined distance from the small diameter portion 21*a* in a longitudinal direction "P" of the exhaust pipes 2.

That is to say, the exhaust way 2 of the exhaust pipe 2*a* has the small diameter portion 21*a* and the large diameter portion 22*a*, being communicated with the exhaust port 93 of the 2-stroke cycle engine 90. The small diameter portion 21*a* has the first honeycomb catalyst portion 3*a*. The large diameter portion 22*a* has the second honeycomb catalyst portion 4*a*. Still, the position "mA" of the small diameter portion 21*a* has an inner diameter of 50 mm. The diameter of the small diameter portion 21*a* is regulated at the position "MA", the inlet of the first honeycomb catalyst portion 3*a*. The large diameter portion 22*a* has an inner diameter of 90 mm. Accordingly, the cross sectional area of the flowing way of the large diameter portion 22*a* is about 3 times as large as that of the small diameter portion 21*a*.

The first honeycomb catalyst portion 3*a*, including a first external sleeve 34, has an outer diameter of 30 mm. The first honeycomb catalyst portion 3*a* is formed as follows: the convolute body is formed by rolling a metallic wave plate 31 and a metallic flat plate 30 in a vortex shape to produce a carrier 3*k* having a large number of holes 32 (honeycomb holes) opening in an axial direction. The plates 30 and 31 are made of metal foil. The first external sleeve 34 is attached at the outer circumferential of the carrier 3*k*. The blazing material is coated on the carrier 3*k* having a length of 20 mm. Afterwards, the carrier 3*k* is heated at a condition of 1200° C.×1h in a vacuum atmosphere to bond the flat plate 30 and the wave plate 31 in a brazing treatment. The metal foil can be steel with heat-resistance and corrosion resistance, such as stainless steel, etc.

Afterwards, the carrier 3*k* with the first external sleeve 34 is soaked in a ceramic slurry for a predetermined hour to coat an alumina ceramic layer on the surface of the plates 30 and 31. Further, the alumina ceramic layer is fired at a firing temperature of about 480–520°. Afterwards, the carrier 3*k* with the external sleeve 34 is soaked in a solution including catalyst component for a predetermined hour so as to retain the catalyst component in the alumina ceramic layer so as to form a catalytic layer. The catalyst component may mainly be platinum (Pt), rhodium (Rh), and palladium (Pd). Still, the axial end surfaces and the outer circumferential surface of the first external sleeve 34 is not covered with the catalytic layer owing to a masking treatment.

Figure 2:
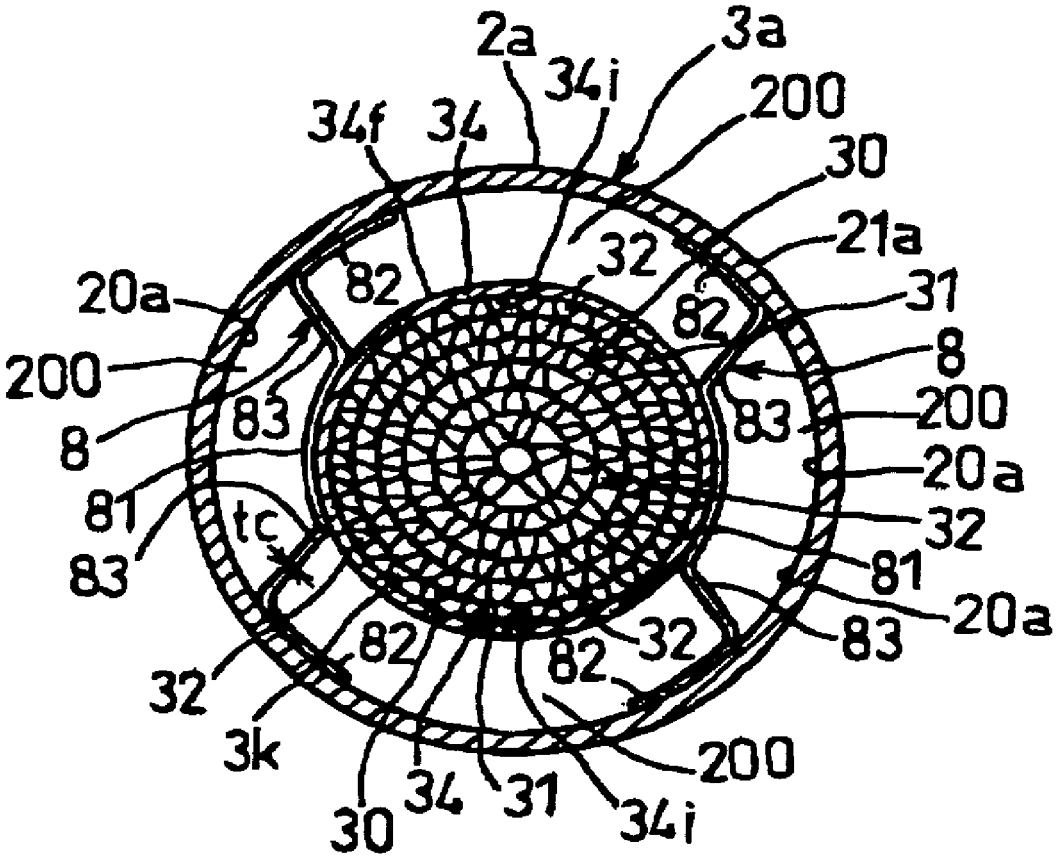
FIG. 2 illustrates a sectional view along II—II line in FIG. 1.

As shown FIG. 1, the first honeycomb catalyst portion 3*a* is placed in the small diameter portion 21*a* formed at the upstream side of the exhaust way 2. As shown in FIG. 2, the first honeycomb catalyst portion 3*a* is held in the small diameter portion 21*a* in a hollow condition by the stay 8 (shown in FIG. 2) working as the first supporting member. The stay 8 is placed between an outer circumferential surface 34*f* of the first external sleeve 34 of the first honeycomb catalyst portion 3*a* and an inwall surface 20*a* of the exhaust pipe 2*a*. The stay 8 is formed of metal with heat-resistance. The stay 8 is formed of a thin member (thickness: Tc) to decrease a passage resistance of the exhaust gas. The stay 8 has a first portion 81, a second portion 82, and a third portion 83. The first portion 81 is brought into contact with the outer circumferential surface 34*f* of the first external sleeve 34 of the first honeycomb catalyst portion 3*a* by welding. The second portion 82 is brought into contact with the inwall surface 20*a* of the exhaust pipe 2*a* by welding. The third portion 83 is connected with the first portion 81 and the second portion 83. Accordingly, the blowing passage 200 of the exhaust gas is formed by the stay 8 between the first external sleeve 34 of the first honeycomb catalyst portion 3*a* and the inwall surface 20*a* of the exhaust pipe 2*a*.

According to the present embodiment, "Sc" exhibits the radial cross sectional area in the catalyst region of the first honeycomb catalyst portions 3*a*. Since "Sc" is the radial cross sectional area of the catalyst region of the first honeycomb catalyst portions 3*a*, "Sc" means the region surrounded by the inner circumferential surface 34*i* of the first external sleeve 34 of the first honeycomb catalyst portions 3*a*. Since "Sc" is regulated at the position "MA" of the inlet of the first honeycomb catalyst portion 3*a*, "Sc" does not contain the radial cross sectional area of the first external sleeve 34, and "Sc" contains the radial cross sectional area of the flowing way of the holes 32 of the first honeycomb catalyst portion 3*a*. Concretely, in the case where the first honeycomb catalyst portion 3*a* is in a sleeve shape, when "D" exhibits the diameter of the inner circumferential surface 34*i* of the first external sleeve 34, the radial cross sectional area of "Sc" of the first honeycomb catalyst portion 3*a* is fundamentally exhibited by $(\pi D^2)/4$.

According to the present embodiment, "St" (suffix t: Total) exhibits the radial cross sectional area of the flowing way defined by the inwall surface 20*a* of the first mounting position 2*f* of the small diameter portion 21*a* out of the exhaust way 2, with the first honeycomb catalyst portion 3*a* being removed. "Sc", "St" are regulated at the position "MA" (shown in FIG. 1), at the inlet of the first honeycomb catalyst portion 3*a*.

Figure 7:
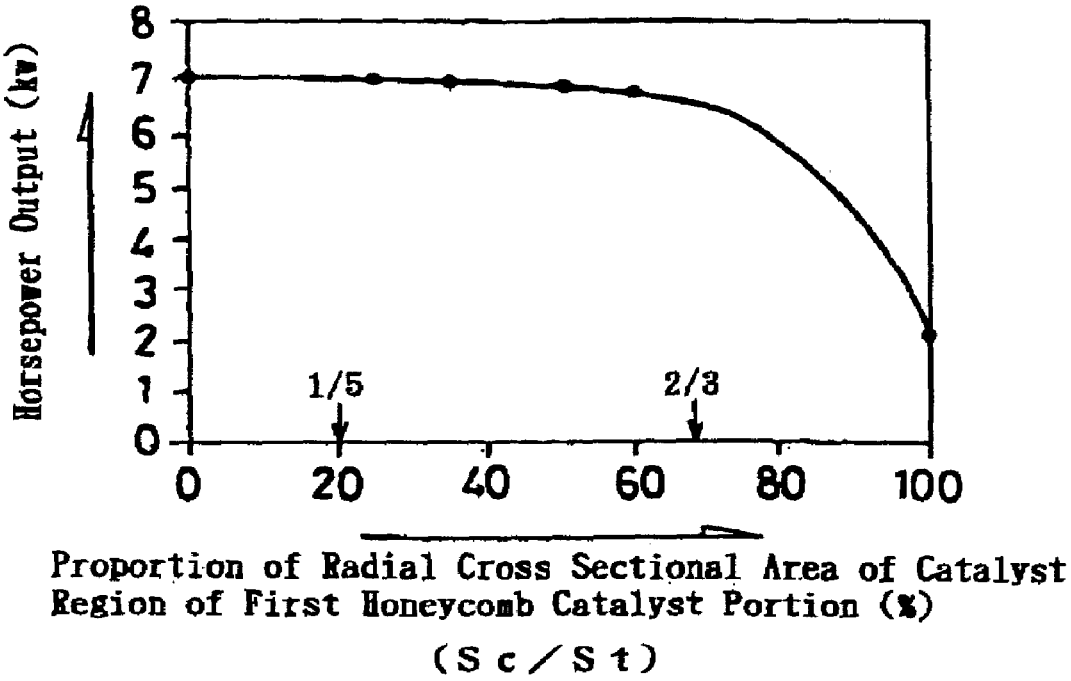
FIG. 7 illustrates a graph concerning Embodiment 1 showing a relationship between a horsepower of an engine output and a ratio, and the ratio exhibits the cross sectional area occupied by a catalyst region of the first honeycomb catalyst portion with respect to all of a cross sectional area of a small diameter portion of an exhaust way.
Figure 8:
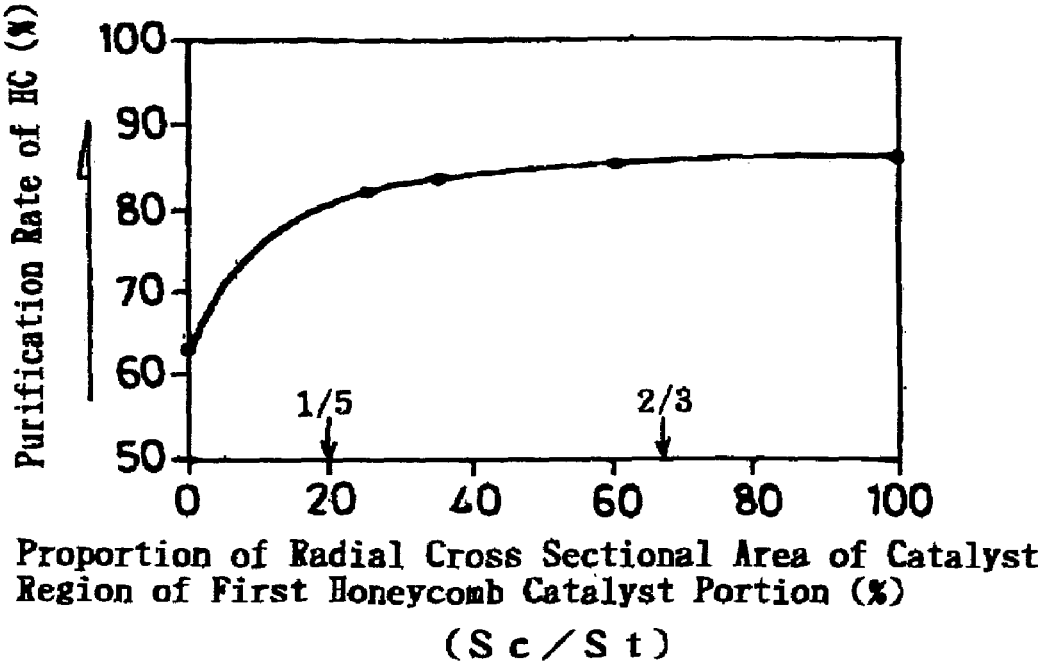
FIG. 8 illustrates a graph concerning Embodiment 1 showing a relationship between a purification rate of HC and a ratio, the ratio exhibits the cross sectional area occupied by a catalyst region of the first honeycomb catalyst portion with respect to all of a cross sectional area of a small diameter portion of an exhaust way.

The reason why the ratio of Sc/St is set in the 1/5–2/3 range are as follows: FIG. 8 shows that when the ratio of Sc/St is less than 1/5, the purification rate of the exhaust gas remarkably decreases. FIG. 7 shows that when the ratio of Sc/St exceeded 2/3, the engine output remarkably decreases.

Moreover, the density of holes 32 of the first honeycomb catalyst portion 3*a* is set in the range of 40–200 cells per square inch, concretely 100 cells per square inch. When the density of holes 32 of the first honeycomb catalyst portion 3*a* is less than 40 cells per square inch, the active performance of the first honeycomb catalyst portion 3*a* and the structural strength are insufficient. When the density of holes 32 of the first honeycomb catalyst portion 3*a* exceeds 200 cells per square inch, the pressure loss of the first honeycomb catalyst portion 3*a* increases and the engine output decreases.

The axial length of the first honeycomb catalyst portion 3*a* along a flow direction of the exhaust gas is 0.5–1 times as large as the diameter of the first honeycomb catalyst portion 3*a* including the first external sleeve 34.

The second honeycomb catalyst portion 4*a* has an outer diameter of 70 mm. The second honeycomb catalyst portion 4*a* is formed like the first honeycomb catalyst portion 3*a* as follows: a convolute body is formed by rolling a metallic wave plate 41 and a metallic flat plate 40 in a vortex shape to produce a carrier 4*k* having a large number of holes 42—honeycomb holes—opening in an axial direction. The carrier 4*k* has a length of 50 mm, and the density of holes of 100 cells per square inch. A second external sleeve 44 is attached at the outer circumferential surface of the carrier 4*k*. Afterwards, the blazing material is coated on the carrier 4*k*. The carrier 4*k* is heated at a condition of 1200° C.×1 h in a vacuum atmosphere to bond the flat plate 40 and the wave plate 41 in a brazing treatment.

Afterwards, the carrier 4*k* with the first external sleeve 44 is soaked in a ceramic slurry for the predetermined hour to coat an alumina ceramic layer on the surface of the carrier 4*k*. Further, the alumina ceramic layer is fired at a firing temperature.

The second honeycomb catalyst portion 4*a* is placed at the large diameter portion 22*a* which is placed about 200 mm apart in the downstream side from the outlet of the first honeycomb catalyst portion 3*a* in the small diameter portion 21*a* along a longitudinal direction "P".

Figure 3:
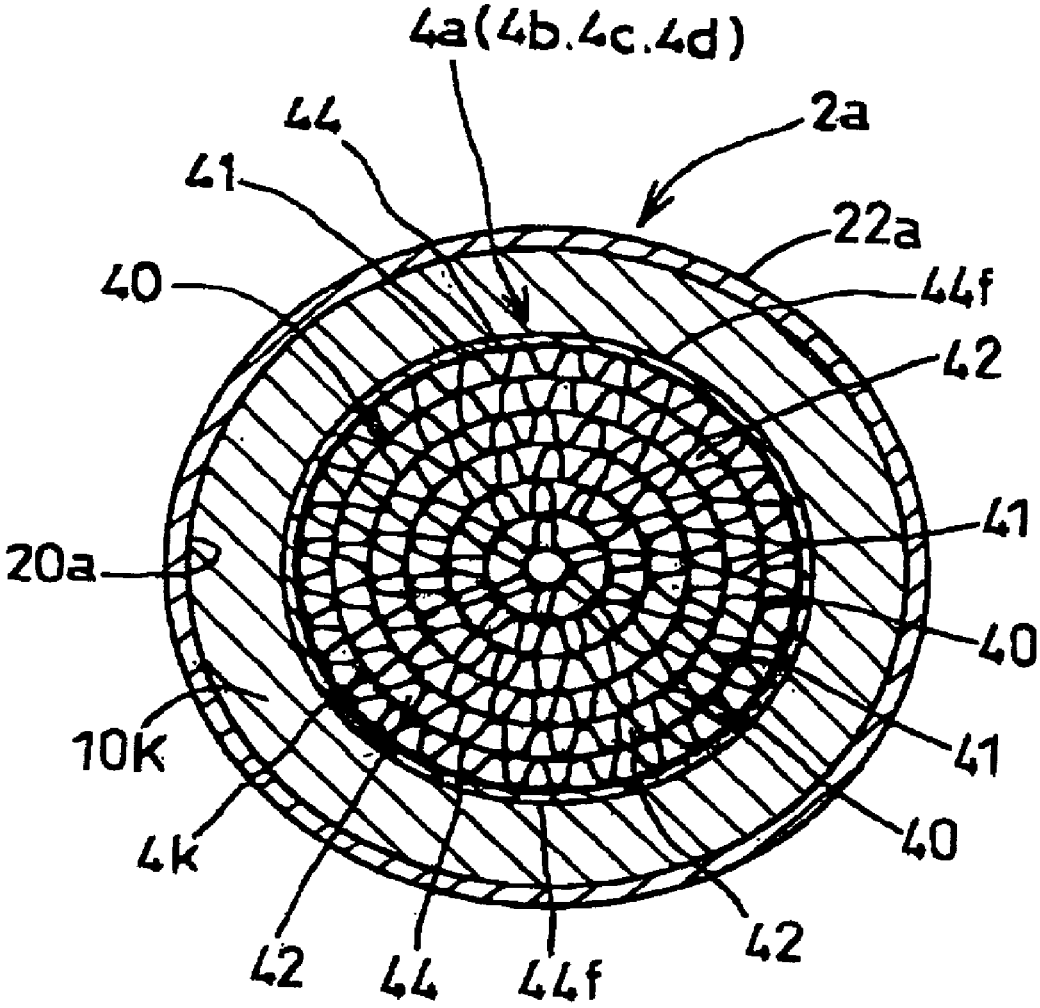
FIG. 3 illustrates a sectional view along III—III line in FIG. 1.

As shown in FIG. 3, the second honeycomb catalyst portion 4*a* is held in the large diameter portion 22*a* by a parting plate 10K having a ring shape which works as a second supporting member. The parting plate 10K is placed between the inwall surface 20*a* of the exhaust way 2 of the exhaust pipe 2*a* and the outer circumferential surface of the second honeycomb catalyst portions 4*a*. The parting plate 10K closes or substantially closes the space between the inwall surface 20*a* of the exhaust way 2 of the exhaust pipe 2*a* and the outer circumferential surface 44*f* of the second external sleeve 44 of the second honeycomb catalyst portion 4*a*.

The exhaust gas purifying apparatus 1A is used for discharging the exhaust gas from the exhaust port 93 of the 2-stroke cycle engine 90 of the motorcycle to the exhaust way 2 of the exhaust pipe 2*a*. As understood from FIG. 1, the exhaust gas is introduced from exhaust port 93 of the exhaust way 2, it runs through the small diameter portion 21*a* and the large diameter portion 22*a* of the exhaust way 2 in sequence.

That is to say, the exhaust gas discharged from the exhaust port 93 of the engine 90 is divided into one flow and the other flow. The one flow runs through a large number of holes 32 of the first honeycomb catalyst portion 3*a* of the small diameter portion 21*a*. The other flow runs through the blowing passage 200 placed at the outer circumferential side of the first honeycomb catalyst portion 3*a*. In the first honeycomb catalyst portion 3*a*, the exhaust gas just discharged from the exhaust port 93 of the engine 90 is introduced into the holes 32 to react with the first honeycomb catalyst portion 3*a* to be heated by the catalyst reaction. So, the high-temperature exhaust gas runs through the second honeycomb catalyst portion 4*a*, and purification ability is advantageously ensured by the second honeycomb catalyst portion 4*a*. Namely, this can advantageously keep the exhaust gas of the second honeycomb catalyst portion 4*a* high in temperature.

The gas, which runs through the blowing passage 200 placed at the outer surface of the first honeycomb catalyst portion 3*a*, is not substantially purified by the first honeycomb catalyst portion 3*a*. Such gas, however, is purified by the second honeycomb catalyst portion 4*a*, since it runs through the holes 42 of the second honeycomb catalyst portion 4*a*. Accordingly, the exhaust gas is efficiently purified in the second honeycomb catalyst portion 4*a* placed at the downstream, being in a condition that catalytic reaction is improved.

According to the present embodiment, the exhaust gas, discharged from the exhaust port 93 of the engine 90 to the exhaust passage 2, is purified by both of the first honeycomb catalyst portion 3*a* and the second honeycomb catalyst portion 4*a* so as to increase a purification rate. The former is placed in the small diameter portion 21*a* being formed at the upstream side of the exhaust way 2. The latter is placed at the large diameter portion 22*a* being formed in the downstream side separated at a predetermined distance in a longitudinal "P" from the outlet of the small diameter portion 21*a*. Moreover, the blowing passage 200, placed in the small diameter portion 21 of the exhaust way 2, can suppress the decrease of the engine output.

Still, according to the exhaust gas purifying apparatus 1A of Embodiment 1, the ratio of Sc/St exhibits a proportion of the radial cross sectional area of the catalyst region of the first honeycomb catalyst portion 3*a* with respect to the radial cross sectional area of the small diameter portion 21*a* of the exhaust way 2. The ratio of Sc/St affects an output and a purification rate of HC in the 2-stroke cycle engine 90. Accordingly, the ratio of Sc/St is varied in the 1/5–2/3 range.

The exhaust way 2 has the large diameter portion 22*a* having a large flow area and the small diameter portion 21*a* having a small flow area. As shown in FIG. 1, when the second honeycomb catalyst portion 4*a* is placed at the large diameter portion 22*a*, the first honeycomb catalyst portion 3*a* is placed in the small diameter portion 21*a*, being near to the engine 90 in view of installation. In case of the motorcycle, installation is restricted owing to its small-space. The small diameter portion 21*a* is smaller than the large diameter portion 22*a* in a radial cross sectional area. It is also considered that a honeycomb catalyst portion formed of a ceramic honeycomb carrier is placed in the small diameter portion 21*a*. However, this case induces a problem that the area of flowing way of the honeycomb-holes is smaller and the passage resistance of the exhaust gas is higher, since a wall of the ceramic honeycomb is thicker than that of the metallic carrier 3*k*. According to the present embodiment, since the carrier 3*k* of the first honeycomb catalyst portion 3*a* is formed by rolling the flat plate 30 and the wave plate 31 made of metal foil, the wall thickness of the honeycomb of the carrier 3*k* is thinner than that of the ceramic honeycomb carrier. So, the area of the flowing way of the holes 32 is ensured to decrease the passage resistance of the exhaust gas, thereby improving the passage ability of the exhaust gas.

The first honeycomb catalyst portion 3*a*, being near to the exhaust port 93 of the engine 90, tends to be in high temperatures. However, the first honeycomb catalyst portion 3*a* is formed of metallic carrier 3*k*, thereby increasing a thermal conductivity to the exhaust pipe 2*a*. This advantageously prevents the metallic carrier 3*k* of the first honeycomb catalyst portion 3*a* from being injured by heat, although the first honeycomb catalyst portion 3*a* is near to the exhaust port 93 of the engine 90.

The case of Sc/St=1 exhibits that all of the flow way of the small diameter portion 21*a* is covered by the first honeycomb catalyst portion 3*a*. Since the first honeycomb catalyst portion 3*a* forms the blowing passage 200 at the outer circumferential side thereof in the present embodiment, the heat quantity received by the first honeycomb catalyst portion 3*a* is suppressed in comparison with the case where Sc/St=1. In this meaning, the metallic carrier 3*k* of the first honeycomb catalyst portion 3*a* is advantageously suppressed from being injured by heat, although the first honeycomb catalyst portion 3*a* is near to the exhaust port 93 of the engine 90.

Embodiment 2

Embodiment 2 is substantially the same as Embodiment 1 in construction, function and effect. The surroundings of difference will be hereinafter described. FIG. 1 illustrates an exhaust gas purifying apparatus 1B of Embodiment 2. The exhaust gas purifying apparatus 1B has an exhaust pipe 2*a*, a first honeycomb catalyst portion 3*b*, and a second honeycomb catalyst portion 4*b*. The exhaust pipe 2*a* forms the exhaust way 2 communicated with the exhaust port 93 of the 2-stroke cycle engine 90. The first honeycomb catalyst portion 3*b* is placed in a first mounting position 2*f* of a small diameter portion (the first catalyst region) 21*b* formed at the upstream side of the exhaust way 2. The second honeycomb catalyst portion 4*b* is placed in a second mounting position 2*s* of a large diameter portion 22*b* (the second catalyst region) formed at the downstream side separated at a predetermined distance from the small diameter portion 21*b* in a longitudinal direction "P" of the exhaust pipes 2*a*.

That is to say, the small diameter portion 21*b* of the exhaust way 2 at the front side of the exhaust pipe 2*a* has an inner diameter of 45 mm. The first honeycomb catalyst portion 3*b* held in the small diameter portion 21*b* by the stay 8 (shown in FIG. 2) has an outer diameter of 35 mm, a length of 20 mm, and a hole density of 100 cells per squire inch. The blowing passage 200 is formed between the first honeycomb catalyst portion 3*b* and the inwall surface 20*a* of the exhaust pipe 2*a*.

The large diameter portion 22*b* of the exhaust way 2 disposed at the rear side of the exhaust pipe 2*a* has an inner diameter of 90 mm. The second honeycomb catalyst portion 4*b* held by the parting plate 10K (shown in FIG. 3) in the large diameter portion 22*b* about 100 mm apart from an outlet of the first honeycomb catalyst portion 3*b*. The second honeycomb catalyst portion 4*b*, including the second external sleeve 44, has an outer diameter of 75 mm, a length of 50 mm, and a hole density of 40 cells per squire inch.

Embodiment 3

Embodiment 3 is substantially the same as Embodiment 1 in construction, function and effect. The surroundings of difference will be hereinafter described. FIG. 1 also illustrates an exhaust gas purifying apparatus 1C of Embodiment 3. The exhaust gas purifying apparatus 1C has an exhaust pipe 2*a*, a first honeycomb catalyst portion 3*c*, and a second honeycomb catalyst portion 4*c*. The exhaust pipe 2*a* forms the exhaust way 2 communicated with the exhaust port 93 of the 2-stroke cycle engine 90. The first honeycomb catalyst portion 3*c* is placed in a first mounting position 2*f* of a small diameter portion (the first catalyst region) 21*c* formed at the upstream side of the exhaust way 2. The second honeycomb catalyst portion 4*c* is placed in the second mounting position 2*s* of a large diameter portion 22*c* (the second catalyst region) formed at the downstream side separated at a predetermined distance from the outlet of the small diameter portion 21*c* in a longitudinal direction "P" of the exhaust pipe 2*a*.

The small diameter portion 21*c* of the exhaust way 2 has an inner diameter of 60 mm. The first honeycomb catalyst portion 3*c* is held in the small diameter portion 21*c* by a ring-shaped parting plate 10K (thinness: 2 mm, shown in FIG. 2). The first honeycomb catalyst portion 3*c*, including a first external sleeve 34, has an outer diameter of 35 mm, a length of 20 mm, and a hole density of 200 cells per squire inch. The blowing passage 200 is formed between the first honeycomb catalyst portion 3*c* and the inwall surface 20*a* of the exhaust pipe 2*a*.

The large diameter portion 22*c* of the exhaust way 2 has an inner diameter of 90 mm. The second honeycomb catalyst portion 4*c* is held by the ring-shaped parting plate 10K (shown in FIG. 3) in the large diameter portion 22*c* about 100 mm apart from the outlet of the first honeycomb catalyst portion 3*c*. The second honeycomb catalyst portion 4*c*, including the second sleeve 44, has an outer diameter of 70 mm, a length of 50 mm, and a hole density of 100 cells per squire inch.

Embodiment 4

Embodiment 4 is substantially the same as Embodiment 1 in construction, function and effect. The surroundings of difference will be hereinafter described, FIG. 1 also illustrates an exhaust gas purifying apparatus 1D of Embodiment 4. The exhaust gas purifying apparatus 1D has an exhaust pipe 2*a*, a first honeycomb catalyst portion 3*d*, and a second honeycomb catalyst portion 4*d*. The exhaust pipe 2*a* forms the exhaust way 2 communicated with the exhaust port 93 of the 2-stroke cycle engine 90. The first honeycomb catalyst portion 3*d* is placed in a first mounting position 2*f* of a small diameter portion (the first catalyst region) 21*d* formed at the upstream side of the exhaust way 2. The second honeycomb catalyst portion 4*d* is placed in a second mounting position 2*s* of a large diameter portion 22*d* (the second catalyst region) formed at the downstream side separated at a predetermined distance from the outlet of the small diameter portion 21*d* in a longitudinal direction "P" of the exhaust pipe 2.

The small diameter portion 21*d* of the exhaust way 2 has an inner diameter of 60 mm. The first honeycomb catalyst portion 3*d* is held in the small diameter portion 21*d* by the stay 8 (shown in FIG. 2). The first honeycomb catalyst portion 3*d*, including the first external sleeve 34, has an outer diameter of 35 mm, a length of 20 mm, and a hole density of 100 cells per squire inch. The blowing passage 200 is formed between the first honeycomb catalyst portion 3*d* and the inwall surface 20*a* of the exhaust pipe 2*a*.

The large diameter portion 22*d* of the exhaust way 2 has an inner diameter of 90 mm. The second honeycomb catalyst portion 4*d* is held by the ring-shaped parting plate 10K (shown in FIG. 3) in the large diameter portion 22*d* about 200 mm apart from the outlet of the first honeycomb catalyst portion 3*d*. The second honeycomb catalyst portion 4*d* has an outer diameter of 70 mm, a length of 50 mm, and a hole density of 200 cells per squire inch.

Embodiment 5

Figure 4:
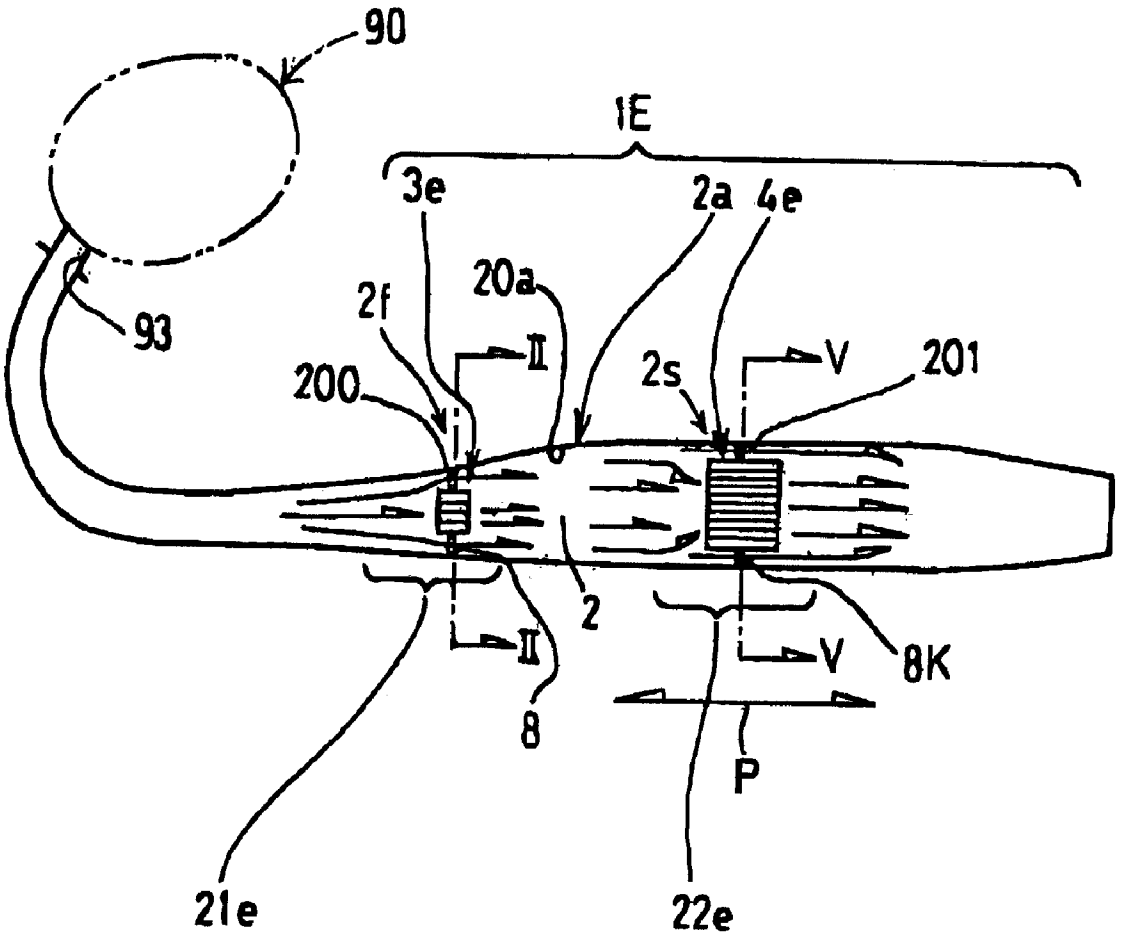
FIG. 4 schematically illustrates a sectional view showing a condition that an exhaust gas purifying apparatus.

Embodiment 5 is substantially the same as Embodiment 1 in construction, function and effect. The surroundings of difference will be hereinafter described. FIG. 4 also illustrates an exhaust gas purifying apparatus 1E of Embodiment 5. The exhaust gas purifying apparatus 1E has an exhaust pipe 2*a*, a first honeycomb catalyst portion 3*e*, and a second honeycomb catalyst portion 4*e*. The exhaust pipe 2*a* forms the exhaust way 2 communicated with the exhaust port 93 of the 2-stroke cycle engine 90. The first honeycomb catalyst portion 3*e* is placed in a first mounting position 2*f* of a small diameter portion (the first catalyst region) 21*e* formed at the upstream side of the exhaust way 2. The second honeycomb catalyst portion 4*e* is placed in a second mounting position 2*s* of a large diameter portion 22*e* (the second catalyst region) formed at the downstream side separated at a predetermined distance from the outlet of the small diameter portion 21*e* in a longitudinal direction "P" of the exhaust pipe 2.

In Embodiment 5, the small diameter portion 21*e* of the exhaust way 2 has an inner diameter of 60 mm. The first honeycomb catalyst portion 3*e* is held in the small diameter portion 21*e* by the stay 8 (shown in FIG. 2). The first honeycomb catalyst portion 3*e*, including the first external sleeve 34, has an outer diameter of 35 mm, a length of 20 mm, and a hole density of 100 cells per squire inch. The blowing passage 200 is formed between the first honeycomb catalyst portion 3*e* and the inwall surface 20*a* of the exhaust pipe 2*a*.

Figure 5:
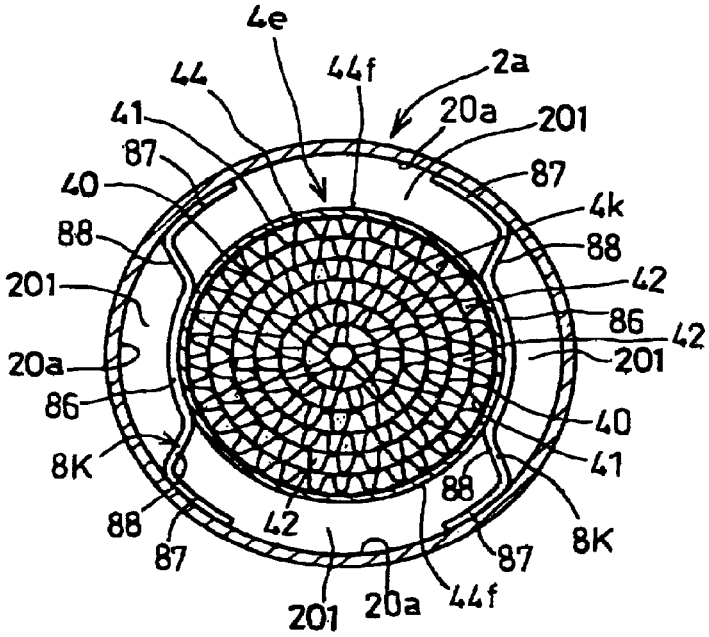
FIG. 5 illustrates a sectional view along V—V line in FIG. 4.

The large diameter portion 22*e* of the exhaust way 2 has an inner diameter of 90 mm. The second honeycomb catalyst portion 4*e* is held by the second stay 8K (shown in FIG. 5), working as a second supporting member, in the large diameter portion 22*e* about 100 mm apart from the outlet of the first honeycomb catalyst portion 3*e*. The stay 8K is formed of a thin plate member to decrease a passage resistance of the exhaust gas. The stay 8K has a first portion 86, a second portion 87, and a third portion 88. The first portion 86 is brought into contact with the outer circumferential surface 44*f* of the second external sleeve 44 of the second honeycomb catalyst portion 4*e* by welding. The second portion 87 is brought into contact with the inwall surface 20*a* of the exhaust pipe 2*a* by welding. The third portion 88 is connected with the first portion 86 and the second portion 88. Accordingly, the second blowing passage 201 for discharging the exhaust gas is formed by the stay 8K between the second external sleeve 44 of the second honeycomb catalyst portion 4*e* and the inwall surface 20*a* of the exhaust pipe 2*a*. The second honeycomb catalyst portion 4*e*, including the second external sleeve 44, has an outer diameter of 70 mm, a length of 50 mm, and a hole density of 200 cells per squire inch. According to the present embodiment shown in FIGS. 4 and 5, the exhaust gas is purified by both of the first honeycomb catalyst portion 3*e* and the second honeycomb catalyst portion 4*e* to improve a purification rate. Moreover, the second blowing passage 201, placed at the outer circumferential side of the second honeycomb catalyst portion 4*e*, can discharge the exhaust gas while ensuring a purification ability, thereby suppressing the decrease of the engine output.

Embodiment 6

Figure 6:
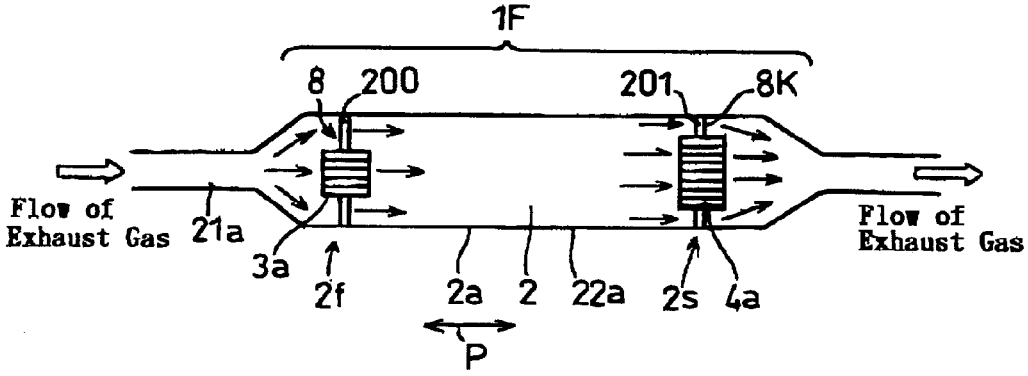
FIG. 6 schematically illustrates a sectional view showing a condition that an exhaust gas purifying apparatus concerning Embodiment 6 along a flow direction of exhaust gas.

Embodiment 6 is substantially the same as Embodiment 1 in construction, function and effects. The surroundings of difference will be hereinafter described. FIG. 6 illustrates an exhaust gas purifying apparatus 1F of Embodiment 6. The exhaust gas purifying apparatus 1F of Embodiment 6 has an exhaust pipe 2*a*, a first honeycomb catalyst portion 3*a*, and a second honeycomb catalyst portion 4*a*. The exhaust pipe 2*a* forms an exhaust way 2 communicated with the exhaust port 93 of the 2-stroke cycle engine 90. The first honeycomb catalyst portion 3*a* is placed in a first mounting position 2*f* formed at the upstream side of the exhaust way 2. The second honeycomb catalyst portion 4*a* is placed in the second mounting position 2*s* formed at the downstream side separated at a predetermined distance from the first honeycomb catalyst portion 3*a* in a longitudinal direction "P" of the exhaust pipe 2*a*. The portion having the first honeycomb catalyst portion 3*a* and the second honeycomb catalyst portion 4*a* out of the exhaust pipe 2*a* is substantially formed in a straight shape. The blowing passage 200 is formed at the outer circumferential side of the first honeycomb catalyst portion 3*a*. The second stay 8K holds the second honeycomb catalyst portion 4*a*, thereby forming the second blowing passage 201 at the outer circumferential side thereof. The ratio of Sc/St is set in the 1/5–2/3 range. On occasion, the second honeycomb catalyst portion 4*a* may be held by the parting plate 10K (shown in FIG. 3) working as the second supporting member.

Rough Calculation Value

Table 1 shows results of Sc, St, Sc/St, and Sc/Sb concerning Embodiments 1–5. The value of "Sc", being calculated roughly, contains a cross sectional area of the first external sleeve 34 of the first honeycomb catalyst portions 3*a*. However, the cross sectional area of the first external sleeve 34 can substantially be disregarded, being smaller than a cross sectional area of "Sc" or "St". According to Table 1 showing Embodiments 1–5, the ratio of Sc/St is set in the 1/5–2/3 range, in the 0.2–0.67 range, namely in the 20%–67% range. So, Embodiments 1–5 can raise the purification rate of the exhaust gas while suppressing the decrease of the engine output.

Still, according to Embodiments 1–5, the ratio of Sc/Sb is set in the 0.25–2.06 range, namely, the 25%–206% range. As above-mentioned, "Sc" exits the radial cross sectional area in the catalyst region of the first honeycomb catalyst portion 3*a*, namely, the area defined by the inner circumferential surface 34*i* of the first external sleeve 34. "Sb" exhibits a radial cross sectional area of the flow way of the blowing passage 200.

TABLE 1

| | Rough Calculation Value | | | |
|---|---|---|---|---|
| | Sc ($mm^2$) | St ($mm^2$) | Sc/St | Sc/Sb |
| Embodiment 1 | 707 | 1963 | 0.36 | 0.56 |
| Embodiment 2 | 962 | 1590 | 0.61 | 1.53 |
| Embodiment 3 | 962 | 2826 | 0.34 | 0.52 |
| Embodiment 4 | 962 | 2826 | 0.34 | 0.52 |
| Embodiment 5 | 962 | 2826 | 0.34 | 0.52 |

TABLE 2

| | L (mm) | D (mm) | L/D |
|---|---|---|---|
| Embodiment 1 | 20 | 30 | 0.67 |
| Embodiment 2 | 20 | 35 | 0.57 |
| Embodiment 3 | 20 | 35 | 0.57 |
| Embodiment 4 | 20 | 35 | 0.57 |
| Embodiment 5 | 20 | 35 | 0.57 |

"L" exhibits a length of the first honeycomb catalyst portion 3*a*, and "D" exhibits a diameter of the first honeycomb catalyst portion 3*a* including the first external sleeve 34, Table 2 shows "L", "D", and "L/D".

EXAMPLE 1

According to Example 1, the present inventors varied the ratio of Sc/St in using the exhaust gas purifying apparatus 1A concerning Embodiment 1. In Example 1, the present inventors evaluated a relationship between an output of the engine and a purification rate of hydrocarbon (HC), using a 2-stroke cycle engine of the motorcycle. FIGS. 7 and 8 show results.

(1) About Evaluation (Shown in FIG. 7) of an Output of the 2-Stroke Cycle Engine (Test Condition)

motorcycle: 120 cc motorcycle with a 2-stroke cycle engine measurement conditions: full throttle and horsepower in 8000 rpm specification: A first honeycomb catalyst portion 3*a* with an a length of 20 mm was placed in an exhaust way having an inner diameter of 50 mm, in the front side of the exhaust pipe. Then, the diameter of the first honeycomb catalyst portion 3*a* was varied so that the ratio of Sc/St may vary in the 0%–100% range. 0% means the condition that the first honeycomb catalyst portion 3*a* is not placed. 100% means the condition that all of the area of the flowing way of the small diameter portion 21*a* was closed by the first honeycomb catalyst portion 3*a*. The second honeycomb catalyst portion 4*a* was placed at the rear side 200 mm apart from the outlet of the first honeycomb catalyst portion 3*a*. The second honeycomb catalyst portion 4*a* had an outer diameter of 70 mm, a length of 50 mm, and a hole density of 100 cells per square inch.

(2) About Purification Rate of HC (shown in FIG. 8)

motorcycle: 120 cc motorcycle with a 2-stroke cycle engine measurement condition: ISO Standard 6460 (ISO: International Organization for Standardization)

specification: A first honeycomb catalyst portion 3*a* with a length of 20 mm was placed in the exhaust way having an inner diameter of 45 mm in front side of the exhaust pipe. Then, the diameter of the first honeycomb catalyst portion 3*a* was varied so that the ratio of Sc/St may vary in the 0%–100% range. The second honeycomb catalyst portion 4*a* was placed at the rear side 200 mm apart from the outlet of the first honeycomb catalyst portion 3*a*. The second honeycomb catalyst portion 4*a* had an outer diameter of 70 mm, a length of 50 mm, and a hole density of 100 cells per square inch.

The horizontal axis of FIG. 7 shows the proportion of the radial cross sectional area of the catalyst region of the first honeycomb catalyst portions 3*a* with respect to all of the area of the flowing way of the small diameter portion 21*a* not including the first honeycomb catalyst portions 3*a*. In short, the horizontal axis of FIG. 7 shows the ratio between the radial cross sectional area of the catalyst region of the first honeycomb catalyst portion 3*a* and all of the radial cross sectional area of the flowing way of the small diameter portion 21*a*, with the first honeycomb catalyst portion 3*a* being removed. Accordingly, the horizontal axis of FIG. 7 shows the ratio of Sc/St. The vertical axis of FIG. 7 shows the horsepower output of the engine 90. As shown by a characteristic line of FIG. 7, the horsepower of the engine rapidly lowers when the ratio of Sc/St exceeds 2/3 (about 67%).

The horizontal axis of FIG. 8 shows the proportion of the radial cross sectional area in the catalyst region of the first honeycomb catalyst portion 3*a* with respect to all of the area of the flowing way of the small diameter portion 21*a*. Namely, the horizontal axis of FIG. 8 shows the ratio of Sc/St. The vertical axis of FIG. 8 shows a purification rate of HC. As shown by a characteristic line of FIG. 8, the purification rate rapidly lowers, when Sc/St is less than 1/5 (20%). Judging from the test results shown in FIGS. 7 and 8, the ratio of Sc/St is preferable in the 1/5–2/3 range, namely the 0.20–0.67 range, the 20%–67% range, for raising the purification rate of the exhaust gas while suppressing the decreasing of the engine output.

EXAMPLE 2

Figure 9:
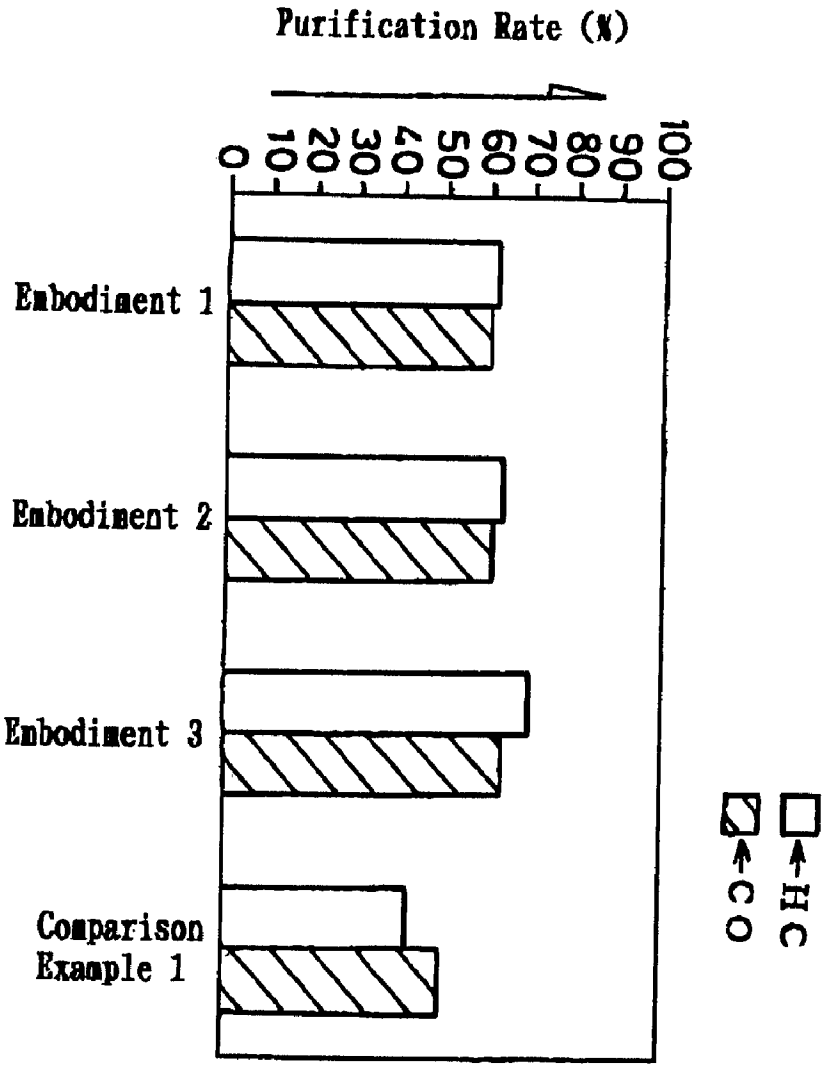
FIG. 9 illustrates a graph showing a purification rate of HC concerning Embodiments 1,2, 3 and Comparison Example 1.
Figure 10:
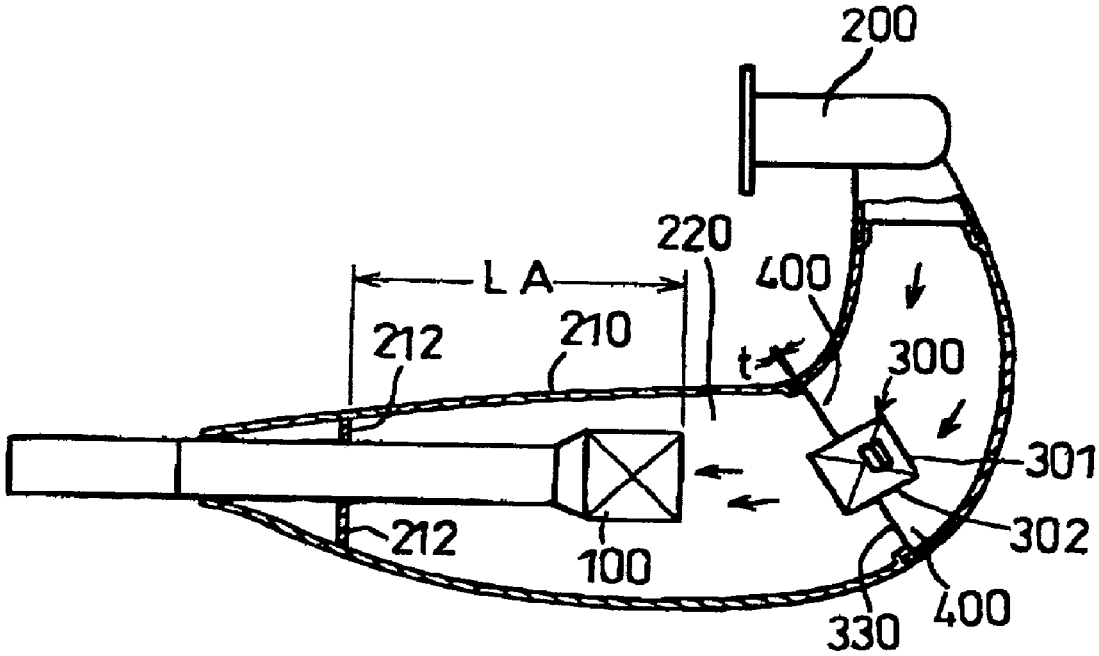
FIG. 10 (Prior Art)
FIG. 10 schematically illustrates a sectional view showing an exhaust gas purifying apparatus concerning the conventional technique along a flow direction of exhaust gas.
Figure 11:
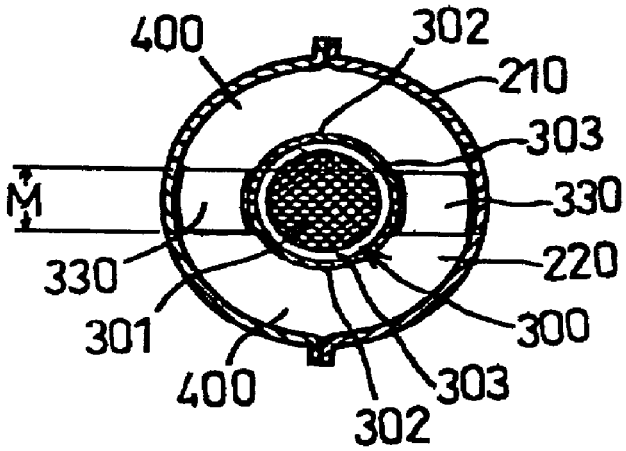
FIG. 11 (Prior Art)
FIG. 11 illustrates a sectional view showing a pre-catalyst of the exhaust gas purifying apparatus concerning the conventional technique along a flow direction of exhaust gas.

The inventors confirmed the effect of the exhaust gas purifying apparatus 1A, 1B, and 1C concerning Embodiments 1–3 in the purification rate of the exhaust gas. FIG. 9 shows the results. Also, the inventors similarly confirmed the exhaust gas purifying apparatus concerning Comparison Example 1. The exhaust gas purifying apparatus concerning Comparison Example 1 has the exhaust pipe 2*a* (shown in FIG. 1) with the exhaust way 2 used in Embodiments 1, 2 and 3, and the cylindrical catalyst placed at the center in a radial direction of the exhaust way 2. The cylindrical catalyst concerning Comparison Example 1 included a catalytic layer and a sleeve having an outer diameter of 35 mm, an inner diameter of 33 mm, a length of 150 mm, and a thickness of 1.0 mm. The sleeve had a large number of punched-holes having a diameter of 3 mm and a pitch of 6 mm. The punched-holes were communicated with an inner circumferential surface and an outer circumferential surface thereof. Evaluation was carried out as follows:

engine: 50 cc, 2-stroke cycle engine evaluation mode: IS0 6460

As shown in FIG. 9, Comparison Example 1 shows that a purification rate of HC is less than 50% and a purification rate of CO is about 50%—an unsatisfactory ability. In the meantime, Embodiments 1–3 shows that a purification rate of HC is more than 60% and a purification rate of CO is more than 60%—an satisfactory ability.

OTHER EXAMPLE

According to Embodiment 1, the second honeycomb catalyst portion 4*a* is placed in the large diameter portion 22*a*, and the first honeycomb catalyst portion 3*a* is placed in the small diameter portion 21*a*—the present invention is not limited to this construction. For example, both of the first honeycomb catalyst portion 3*a* and the second honeycomb catalyst portion 4*a* may sometimes be placed in the large diameter portion 22*a*. In addition, the present invention is not limited only within the above-mentioned embodiments shown in the drawing.

What is claimed is:

1. An exhaust gas purifying apparatus comprising an exhaust pipe for forming an exhaust way communicated with an exhaust port of an engine, and a catalyst disposed in said exhaust way for purifying an exhaust gas;

the improvement comprising:

said exhaust way of said exhaust pipe having a first mounting position and a second mounting position disposed at the downstream side with respect to said first mounting position; and said catalyst having a first honeycomb catalyst portion placed at said first mounting position of said exhaust way and a second honeycomb catalyst portion placed at said second mounting position of said exhaust way, said first honeycomb catalyst portion having an outer circumferential surface for forming a blowing passage with an inwall surface of said exhaust pipe and including a metallic first carrier with a plurality of holes being along a length direction of said exhaust way of said exhaust pipe, said second honeycomb catalyst portion including a metallic second carrier with a plurality of holes being along a length direction of said exhaust way of said exhaust pipe; wherein the radial cross sectional area in a catalyst region of said first honeycomb catalyst portion is set in the 1/5–2/3 range with respect to the radial cross sectional area of a flowing way defined by said inwall surface of said first mounting position of said exhaust way with said first honeycomb catalyst portion being removed.

2. The exhaust gas purifying apparatus according to claim 1, wherein said exhaust way of said exhaust pipe includes a small diameter portion with said first mounting position disposed at the upstream side of said exhaust way, and a large diameter portion with said second mounting position disposed at the downstream side in said exhaust way with respect to said small diameter portion; and wherein said first honeycomb catalyst portion is placed in said small diameter portion and said second honeycomb catalyst portion is placed in said large diameter portion.

3. The exhaust gas purifying apparatus according to claim 1, wherein the density of said holes of said first honeycomb catalyst portion is set in the range of 40–200 cells per square inch.

4. The exhaust gas purifying apparatus according to claim 1, wherein the axial length of said first honeycomb catalyst portion is 0.5–1 times as long as the diameter of said first honeycomb catalyst portion.

5. The exhaust gas purifying apparatus according to claim 1, wherein said first honeycomb catalyst portion is installed at said first mounting position of said exhaust way by a first supporting member placed between said inwall surface of said exhaust way and said outer circumferential surface of said first honeycomb catalyst portion.

6. The exhaust gas purifying apparatus according to claim 1, wherein said first honeycomb catalyst portion and said second honeycomb catalyst portion are placed to be centered in a cross-section of said exhaust way of said exhaust pipe.

7. The exhaust gas purifying apparatus according to claim 1, wherein said second honeycomb catalyst portion is installed at said second mounting position of said exhaust way by a second supporting member placed between an inwall surface of said second mounting position of said exhaust way and an outer circumferential surface of said second honeycomb catalyst portion.

8. The exhaust gas purifying apparatus according to claim 7, wherein said second supporting member closes or substantially closes a space between said inwall surface of said second mounting position of said exhaust way of said exhaust pipe and said outer circumferential surface of said second honeycomb catalyst portion.

9. The exhaust gas purifying apparatus according to claim 7, wherein said second supporting member forms a second blowing passage of exhaust gas between said inwall surface of said second mounting position of said exhaust way of said exhaust pipe and said outer circumferential surface of said second honeycomb catalyst portion.

10. The exhaust gas purifying apparatus according to claim 1, wherein said first honeycomb catalyst portion includes said metallic first carrier retaining a catalyst component and a first external sleeve for holding an outer circumferential surface of said metallic first carrier; and wherein said second honeycomb catalyst portion includes said metallic second carrier retaining a catalyst component and a second external sleeve for holding an outer circumferential surface of said metallic second carrier.

11. The exhaust gas purifying apparatus according to claim 10, wherein said metallic first carrier of said first honeycomb catalyst portion is formed by bonding a convolute body with blazing material, said convolute body is formed by rolling a metallic wave plate and a metallic flat plate in a vortex shape; and wherein said metallic second carrier of said second honeycomb catalyst portion is formed by bonding a convolute body with blazing material, said a convolute body is formed by rolling a metallic wave plate and a metallic flat plate in a vortex shape.

12. The exhaust gas purifying apparatus according to claim 1, wherein when "Sc" exhibits the radial cross sectional area in the catalyst region of said first honeycomb catalyst portion, and when "Sb" exhibits an area of the flowing way of said blowing passage, the ratio of Sc/Sb is set in the 0.25–2.06 range.

13. The exhaust gas purifying apparatus according to claim 1, wherein said second honeycomb catalyst portion is larger than said first honeycomb catalyst portion in a purifying ability per unit time.

14. An exhaust system of a motorcycle engine, comprising:

the exhaust gas purifying apparatus according to claim 1.

* * * * *